United States Patent [19]

Nigg

[11] Patent Number: 4,825,622

[45] Date of Patent: May 2, 1989

[54] APPARATUS FOR SELECTING AND FEEDING WEB MATERIAL

[75] Inventor: Elias Nigg, Balzers, Liechtenstein

[73] Assignee: Pittacus S. A., Vaduz, Liechtenstein

[21] Appl. No.: 932,257

[22] Filed: Nov. 19, 1986

[30] Foreign Application Priority Data

Nov. 19, 1985 [IT] Italy ..... 12601 A/85

[51] Int. Cl.[4] ..... B65B 41/12

[52] U.S. Cl. ..... 53/203; 53/168; 53/389; 83/650; 225/96; 225/100

[58] Field of Search ..... 53/389, 168, 203, 222; 198/366, 369, 575; 226/110; 83/650; 225/96, 100

[56] References Cited

U.S. PATENT DOCUMENTS

| | | | |
|---|---|---|---|
| 3,662,513 | 5/1972 | Fabbri | 53/463 |
| 3,776,081 | 12/1973 | Becker | 53/389 X |
| 3,983,774 | 10/1976 | Seragnoli | 53/389 X |
| 4,341,586 | 7/1982 | Koutonen | 53/389 X |
| 4,510,731 | 4/1985 | Mathieu | 53/389 X |
| 4,551,962 | 11/1985 | Kawahara | 53/389 X |
| 4,583,348 | 4/1986 | Treiber et al. | 53/389 X |

*Primary Examiner*—Frank T. Yost
*Attorney, Agent, or Firm*—Pollock, Vande Sande & Priddy

[57] ABSTRACT

Apparatus for selecting and feeding web material (F1, F2, F3) from a plurality of supply bobbins (B1, B2, B3) of web material having different characteristics, comprising a selecting and dispensing device arranged on a slide (7) horizontally movable to and fro with respect to a feeder conveyor (T) which finally feeds the film to the packaging station (P) of the packaging machine. On the slide is mounted an indexing arrangement (13, 18) adapted to selectively bring into operative alignment with the feeding conveyor (T) one draw-and-guide unit (A1, A2, A3) which draws the selected film and delivers it to the feeding conveyor (T). The operative engagement between the draw-and-guide units (A1, A2, A3) is obtained by opening the feeding conveyor (T) which consist of a superposed belts conveyor (101, 201) and pinch rollers (R1, R2) and inserting therebetween the forward portion (118, 218, 318) of the draw-and-guide unit. The opening of the feeding conveyor is promoted by the movement of the draw-and-guide unit which carries a roller or opening pin (37) which acts on a shaped plate (3) carrying the upper run (101) of the belt conveyor. Upon engagement of the draw-and-guide unit (A1, A2, A3) with the feeding conveyor (T), there takes place also the operative engagement of a driving wheel (38) arranged on the feeding conveyor (T) with a driven wheel (31) arranged on the draw-and-guide unit, which transmits the drive to the draw wheels (21, 121-22, 122) of the draw-and-guide unit.

7 Claims, 3 Drawing Sheets

APPARATUS FOR SELECTING AND FEEDING WEB MATERIAL

BACKGROUND AND SUMMARY OF THE INVENTION

The present invention relates to an apparatus for selecting and feeding web material which is particularly adapted for use in machines for packaging products into sheets of flexible material, obtained by transversal cutting of a continuous web unreeled from a supply bobbin.

More particularly, the invention relates to automatic machines for packaging, in stretch film, products arranged in trays, such as food products. These machines are capable of packaging products having different sizes, and for this purpose they require stretch film of different widths. Presently, for this purpose, it is known to arrange on the machine frame a plurality of supply bobbins of stretch film having different widths, and to select the film having the required width depending upon the size of the products being packaged. These operations are effected manually, with considerable loss of time, due also to the difficulties in the handling of the stretch film.

The object of the present invention is to provide an apparatus for selecting and feeding web material, such as stretch film, from a plurality of supply bobbins of web material having different characteristics, to a web utilizing machine, such as a packaging machine, in which the web changeover operation, depending upon the size of the product being packaged, is fully automatic.

BRIEF DESCRIPTION OF THE DRAWINGS

The features of the apparatus according to the invention and the advantages deriving therefrom will appear evident from the following detailed description of a preferred embodiment, made with reference to the Figures of the attached drawings, in which.

DESCRIPTION OF THE PREFERRED EMBODIMENT

Figure 1:
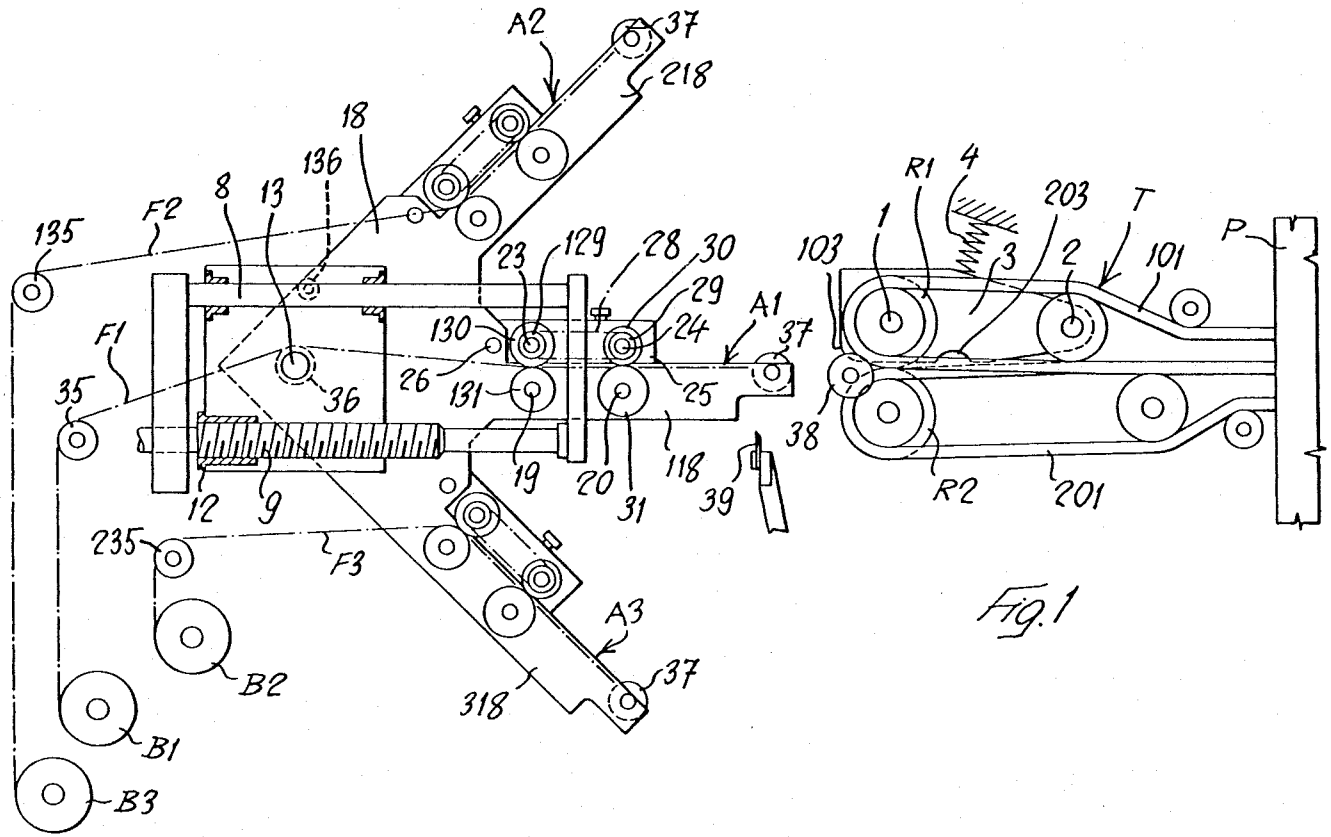
FIG. 1 is a side elevation view of the apparatus, with parts in section.

FIG. 1 shows the conveyor feeding means T cyclically positioning sheets of a foil web F1, F2, F3 at the packaging station P of a packaging machine, said conveyor means T comprising superimposed belts 101, 201 the active runs of which are arranged side by side so as to grip the longitudinal edge of the said web and fold them in a pleated manner, whereby the web is clamped firmly between them while being suitably stretched in a transvers direction. At their initial lead -in or entry portion, the belts are suitably spaced apart so as to facilitate the web coming from the draw-and-guide means A1, A2, A3 to enter therebetween. On the entry shafts of said conveyor means T there are mounted superimposed wheels R1 and R2 covered with rubber rings. The upper wheels R1 are freely rotatable and the lower wheels R2 are keyed to a common shaft which is connected to the driving means for the conveyor means T through a clutch and brake unit ( not shown). When the belt conveyor T is in its operative position, the rings R1 and R2 are in engagement with the foil sheet to be fed to the packaging station of the machine. The details of the conveyor feeding means T are not disclosed herein, since they are known, for example, from U.S. Pat. No. 3,662,513. With respect to the conveyor feeding apparatus illustrated in this U.S. patent, the conveyor feeding means of the present invention are modified as follows: The shafts 1 and 2 around which the upper belts 101 of the conveyor means T are passed at the lead-in or entry portion of the said conveyor means, are supported at their ends by a pair of parallel plates 3 (only one is visible in FIG. 1), which plates 3 are mounted pivotably on shaft 2 and are urged downwardly by gravity or by any suitable elastic or spring means 4. At least one of said plates 3 presents a suitably rounded or chamfered edge 103 at its lower front angle, and a rounded recess 203 at an intermediate position of its lower side. The function of the just described plates 3 will be discussed later.

Upstream of the conveyor feeding means T there is arranged the selecting and dispensing device, which comprises a slide 7 movable on horizontal guide rods 8 which are perpendicular to the shafts 1 and 2 and are secured to the frame of the packaging machine. Parallel to said rods 8 there is arranged a worm screw 9 which can be rotated in either direction through suitable driving means (not shown). The screw 9 cooperates with a nut 12 secured to the slide 7 and which is moved in rectilinear direction, in response to the clockwise or counterclockwise rotation of the screw 9, toward and away with respect to the said conveyor means T. On the slide 7 there is rotatably mounted a shaft 13 which is parallel to the shafts 1 and 2 of the conveyor means T, said shaft 13 being connected to means (not shown) for promoting its rotation in both directions. The shaft 13 can be rotated and locked at predetermined angular positions, so as to act as an indexing device.

Figure 2:
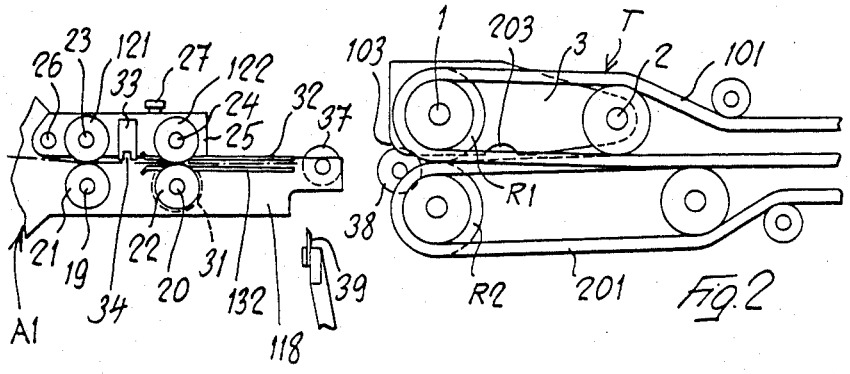
FIGS. 2, 3 and 4 show a detail of the apparatus of FIG. 1, at different stages of its working cycle.

A pair of similar and oppositely arranged plates 18 (only one being shown in FIG. 1) is secured perpendicularly to shaft 13. The plates 18 are provided, integrally or by suitable attachment means, with pairs of oppositely arranged extensions 118, 218, 318 which are suitably angularly spaced with respect to each other, for example at a 45° angle. Said extensions 118, 218, 318 carry the respective draw-and-guide units A1, A2, A3 for the different foil webs F1, F2, F3 unreeled from respective rolls B1, B2 B3 which are mounted on the frame of the packaging machine. Since the web drawand-guide units A1, A2, A3 are identical to each other, only one of them will now be described (see particularly Figures 1 and 2). Each draw-and-guide unit comprises a pair of parallel shafts 19, 20 journalled at their ends on the extensions 118 and having keyed thereto, respectively, two small draw wheels 21, 22 of the same diameter and spaced from each other. Applied on said wheels 21, 22 are auxiliary draw wheels 121, 122 mounted on the shafts 23, 24 which are supported by parallel plates 25, pivoted at 26 to said plates 18 and provide with screws 27 for connection to said extensions 118. By loosening the screws 27, said plates 25 can be lifted from said extensions 118 so that the wheels 121, 122 are lifted from the wheels 21, 22 and the leading edge of the foil web F1 to be handled by the unit can be inserted therebetween.

The shafts 23, 24 are connected by a toothed belt 28 and toothed pulleys 29, 129 having the same diameter. To one end of shafts 23, 24 there are keyed the toothed wheels 30, 130 in mesh with respective toothed wheels 31, 131 which are keyed to the shafts 19, 20. These toothed wheels are dimensioned so that the wheels 21, 22 and 121, 122 will rotate with the same peripheral speed. The toothed wheel 31 is preferably of the unidirectional type so as to permit the shafts 20, 24, 23, 19 to rotate in only one direction thus ensuring the proper positioning of the leading edge of the foil web between the draw wheels.

To the plates 25 and extensions 118 there are secured the pair of superimposed flat-shaped guides 32, 132 through which the foil web is passed and which present a comb-like configuration at both their front and rear portion. The rear comb-like portion extends in part upstream of the pair of wheels 22, 122 while the front comb-like portion extends in such a manner so as to enable said guides 32, 132 to exert their guiding action on the foil web while the same is pinched between the conveyor means T, as will be seen hereinafter.

The rear ends of the said guides 32, 132 are located at a short distance from a transverse counterknife 33 secured to the plates 25 and provided with a longitudinal bottom groove 34, said counterknife being arranged in such a manner that the film running between the pairs of draw wheels 21, 121 and 22, 122 will slide against said grooved bottom.

Still with reference to FIG. 1, the rollers 35, 135, 235, supported by the frame of the machine, will guide foil webs F1, F2, F3 presenting different characteristics unreeled from the supply rolls B1, B2, B3, while further rollers 36 and 136 mounted, respectively, coaxially to shaft 13 and on plates 18 are suitably arranged in order to prevent the contact of the foil webs between one another upon angular movement of the selecting and dispensing device whenever changing the film being supplied. Finally, a roller 37 is provided, which is mounted in cantilever fashion on the outer side of at least one of the extensions 118 (218, 318) of each draw-and-guide unit, and which is arranged on the same imaginary vertical plane containing the plate 3 provided with the recess 203 on its lower side.

Figure 3:
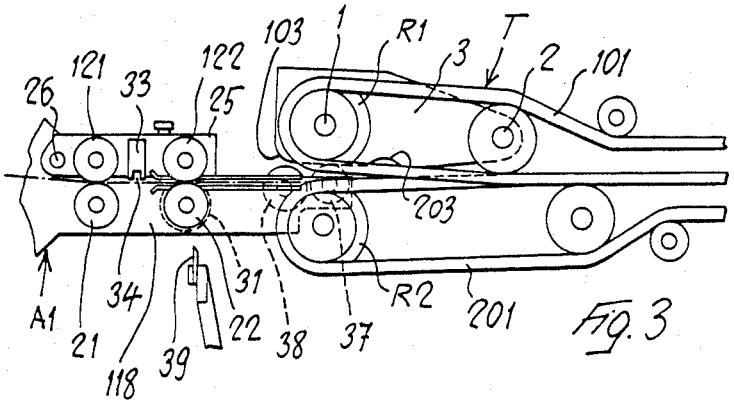
Figure 4:
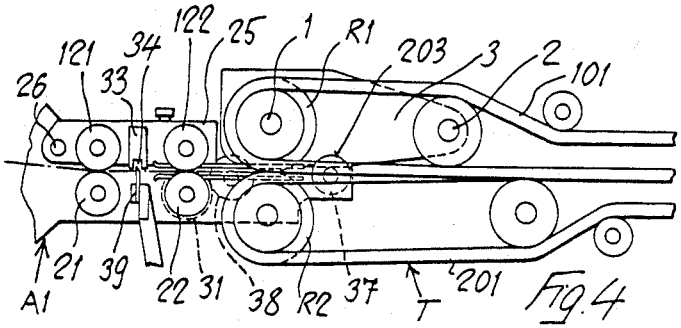

The operation of the apparatus is as follows:

When at rest, the apparatus is in the condition shown in FIG. 1, with the slide 7 at the maximum distance from the feeding means T. In this condition, under control of automatic devices detecting the size of the item to be packaged, or under selective command of the operator, there is automatically selected and prearranged for feeding to the conveyor means T the particular web F1, or F2, or F3 having the required dimensional or other characteristics. As a result of the controlled rotation of the indexing shaft 13, the desired draw-and-guide unit A1 or A2 or A3 is positioned horizontally. The driving means for rotating the screw 9 are actuated, and the slide 7 is caused to move to the right as clearly illustrated in the sequence of Figures 1, 2, 3 and 4. During this forward movement, (see FIG. 3) the roller 37 engages the bottom side of the plate (or plates) 3, and lifts said plates 3 thus moving apart or opening the initial section of the conveyor means T, R1, R2. The leading edge of the foil web F1 can therefore be introduced thereinto while being held fast within the guide means 32, 132. When the roller 37 reaches the recess 203 (FIG. 4), the plates 3 will be lowered, the belts 101, 201 of the conveyor means 7 will close again and the rings R1, R2 will grip the leading edge of the web F1 at the portions which are left free by the comb-like configuration of the guides 32, 132. On completion of the rightwards stroke of the slide 7, the undirectional toothed wheel 31 reaches and meshes with a toothed wheel 38 connected to drive means (not shown) which are energized in combination with the conveyor means T, R1, R2. The active runs of the belts 101, 201 of the said conveyor means T move righwards , in the same direction in which the web is moved by the draw wheels 21, 121 and and 22, 122 and by the rings R1, R2. The linear speed of the belts of the conveyor means T is slightly higher than the peripheral speed of the draw wheels so as to keep the foil web in a suitably stretched condition.

When the desired length of film F1 has moved downstream of the counterknife 33, a notched knife 39 is temporarily lifted so as to penetrate into the groove 34 and to transversely weaken (as known in the art) the said film. Thereafter, when the weakening line has moved downstream of the wheels provided with the rings R1, R2, these wheels and the preceding draw wheels 21, 121, 22, 122 are stopped so that the web F1 will be severed along said weakening line due to the longitudinal tension applied thereto by the belts 101, 201 of the conveyor means T, which will continue to operate to inroduce properly the cut off sheet of web into the packaging station P of the machine.

Figure 5:
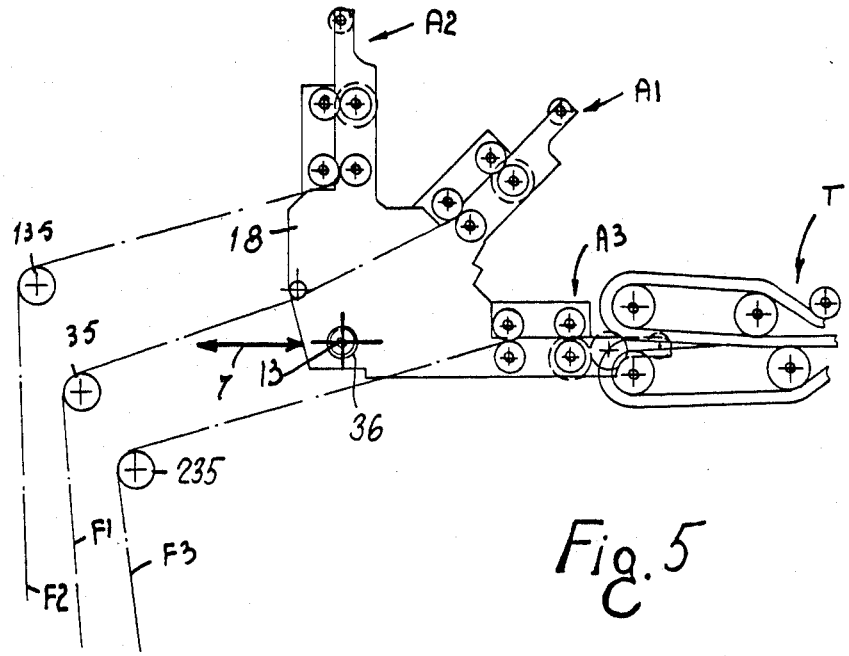
FIGS. 5 and 6 diagrammatically show the apparatus during changeover positions for changing the type of web fed to the packaging machine.
Figure 6:
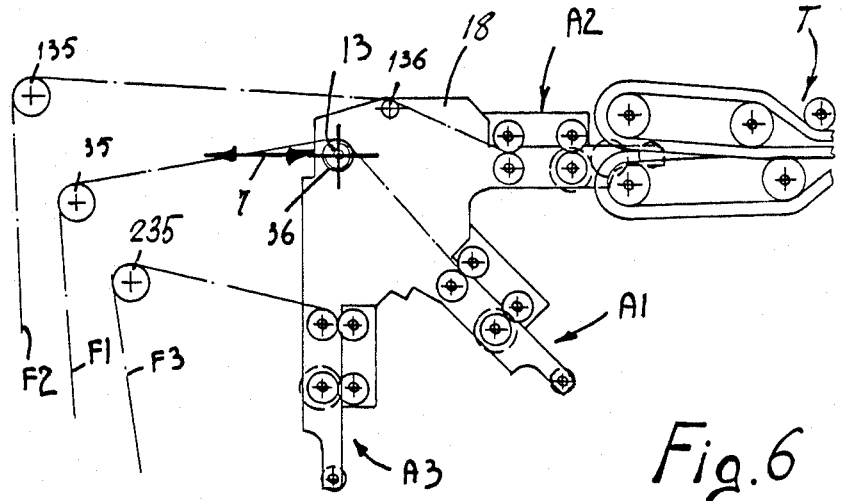

The changeover of the webs to the feeding means T takes place in the following manner:

Both the conveyor means T and the components of the drawand-guide unit (A1 in this case) which is arranged horizontally are stopped. The slide 7 is moved away from the conveyor means T, which, due to the cooperation of the roller 37 with the shaped lower side of the plate 3, will be spread apart, thus permitting the leading edge of the film held by the draw-and-guide unit which was previously operating, to be withdrawn therefrom. The draw-and-guide unit (A1) moves away from the driving wheel 38 and cutting means 39. At this point, the indexing shaft 13 is rotated automatically in clockwise or counterclockwise direction so as to position the desired draw-and-guide unit A2 or A3 (whichever is required) horizontally. After this operation, the feeding cycle can be resumed as described above (see FIGS. 5 and 6).

It is to be understood that the above description relates to a preferred embodiment of the invention, with the omission of the constructional details of the driving and electrical circuits which ensure the proper operation of the device, since thay are easily conceivable by a person skilled in the art. It is to be understood also that many changes and modifications, particularly in construction, may be made to the invention. Thus, for example, the reciprocating movement of the slide 7 may be effected by means different from those described. As an alternative embodiment, the draw-and-guide units A1, A2, A3 can be arranged above each other, horizontally and suitably spaced apart, and may be mounted on suitable vertical raising and lowering means arranged on the slide 7.

I claim:

1. Apparatus for selecting and feeding web material (F1, F2, F3) from one of at least two supplies (B1, B2, B3) of web material to a web-utilizing machine (P), said apparatus comprising a selecting and dispensing device (7, A1, A2, A3) which selectively draws a said web material (F1, F2, F3) from one of said supplies (B1, B2, B3) and is capable of being operatively connected with web feeding means (T) which feed the selected web material to said web-utilizing machine (P), said selecting and dispensing device comprising supporting means (7)

movable towards and away from said web feeding means (T), at least two web draw-and-guide units (A1, A2, A3) being mounted on said supporting means (7), said web draw-and-guide units being selectively brought into operative alignment with said web feeding means (T), each said draw-and-guide unit (A1, A2, A3) comprising superposed draw wheels (21, 121 - 22, 122) which are kinematically connected so as to permit the feeding of said web material (F1, F2, F3) pinched between them, a driving wheel (38) being provided on said feeding means (T), which driving wheel, upon operative engagement of said draw-and-guide unit (A1, A2, A3) with said feeding means (T), transmits the drive to said superposed draw wheels, in such a manner as to allow unidirectional forward movement of said web material from said supply (B1, B2, B3) to said web-utilizing machine (P).

2. Apparatus according to claim 1, wherein said drawand-guide units (A1, A2, A3) are arranged angularly spaced on indexing means (13, 18) rotatably mounted on said supporting means (7), whereby,upon rotation of said indexing means (18), the desired draw-and-guide unit (A1, A2, A3) is brought into operative alignment with said web feeding means (T).

3. Apparatus for selecting and feeding web material (F1, F2, F3) from one of at least two supplies (B1, B2, B3) of web material to a web-utilizing machine (P), said apparatus comprising a selecting and dispensing device (7, A1, A2, A3) which selectively draws a said web material (F1, F2, F3) from one of said supplies (B1, B2, B3) and is capable of being operatively connected with web feeding means (T) which feed the selected web material to said web-utilizing machine (P), said selecting and dispensing device comprising supporting means (7) movable towards and away from said web feeding means (T), at least two web draw-and-guide units (A1, A2, A3) being mounted on said supporting means (7), said web draw-and-guide units being selectively brought into operative alignment with said web feeding means (T), wherein said web feeding means (T) comprise a superposed-belts conveyor (101, 201) and superposed upper and lower pinch wheels (R1, R1) which enable feeding of said web material to the said web-utilizing machine (P), means being provided (3, 103, 203) for promoting the opening or spacing apart of an upper run (101) of said belts and of said upper pinch wheels (R1) with respect to a lower run (201) of said belts and said lower pinch wheels (R2) so as to permit the insertion therebetween of a suitably shaped forward portion (118, 218, 318) of a said draw-and-guide unit (A1, A2, A3), whereby operative engagement between said draw-and-guide units and said feeding means (T) is obtained.

4. Apparatus according to claim 3, in which a first belt group (101) of said conveyor and said corresponding pinch wheels (R1) are mounted, at their initial or lead-in section, on a swingable structure (3) which can be spaced apart with respect to a second belt group (201) and pinch wheels (R2), said swingable structure comprising suitably shaped portions (103, 203) which are engaged and acted upon by suitable rollers or opening pin members (37) carried by said forward portion of said draw-and-guide unit (A1, A2, A3).

5. Apparatus according to claim 3, wherein each draw-and-guide unit (A1, A2, A3) comprises a counterknife (33, 34) which cooperates with a weakening knife (39) mounted for movement on a frame of said machine.

6. Apparatus according to claim 5, wherein each said draw-and-guide unit (A1, A2, A3) comprises a pair of superposed web guiding plates (32, 132) located downstream of said counterknife (33, 34) and presenting openings on their surface so as to permit said web material being passed therebetween to be engaged by superposed draw wheels (22, 122) arranged on said draw-and-guide unit (A1, A2, A3) and by pinch wheels (R1, R2) arranged on said feeding means (T).

7. Apparatus according to claim 6, wherein said web guiding plates (32, 132) have a comb-like configuration.

* * * * *